US009010994B2

(12) United States Patent
McQueen et al.

(10) Patent No.: US 9,010,994 B2
(45) Date of Patent: Apr. 21, 2015

(54) FLOW MIXER AND CONDITIONER

(75) Inventors: Malcolm M. McQueen, Encinitas, CA (US); Donald G. Lundberg, San Marcos, CA (US)

(73) Assignee: Fluid Components International LLC, San Diego, CA (US)

( * ) Notice: Subject to any disclaimer, the term of this patent is extended or adjusted under 35 U.S.C. 154(b) by 304 days.

(21) Appl. No.: 12/831,010

(22) Filed: Jul. 6, 2010

(65) Prior Publication Data

US 2011/0174407 A1 Jul. 21, 2011

Related U.S. Application Data

(63) Continuation-in-part of application No. 12/691,567, filed on Jan. 21, 2010.

(51) Int. Cl.
*B01F 5/06* (2006.01)

(52) U.S. Cl.
CPC ..... *B01F 5/0618* (2013.01); *B01F 2005/0627* (2013.01); *B01F 2005/0639* (2013.01); *B01F 5/0616* (2013.01)

(58) Field of Classification Search
USPC ..... 366/337, 340
See application file for complete search history.

(56) References Cited

U.S. PATENT DOCUMENTS

| | | | | |
|---|---|---|---|---|
| 1,113,041 | A * | 10/1914 | Murphy | 48/189.4 |
| 4,165,609 | A * | 8/1979 | Rudolph | 60/262 |
| 4,929,088 | A | 5/1990 | Smith | |
| 4,981,368 | A | 1/1991 | Smith | |
| 5,029,636 | A * | 7/1991 | Kadle | 165/109.1 |
| 5,937,908 | A * | 8/1999 | Inoshiri et al. | 138/39 |
| 5,967,658 | A * | 10/1999 | Mohajer | 366/337 |
| 6,615,872 | B2 * | 9/2003 | Goebel et al. | 138/38 |
| 2008/0037366 | A1 * | 2/2008 | Smith | 366/337 |
| 2009/0266064 | A1 * | 10/2009 | Zheng et al. | 60/317 |
| 2010/0107617 | A1 * | 5/2010 | Kaiser et al. | 60/324 |

FOREIGN PATENT DOCUMENTS

| | | | |
|---|---|---|---|
| WO | WO2008061734 | * | 5/2008 |
| WO | WO2008143834 | * | 11/2008 |

* cited by examiner

*Primary Examiner* — David Sorkin
(74) *Attorney, Agent, or Firm* — The Maxham Firm

(57) ABSTRACT

A flow mixer and conditioner for use within a conduit conditions flowing media within the conduit to provide a swirl-free, symmetric, and reproducible velocity profile regardless of upstream flow distortions, disturbances, or anomalies. Tabs are cut from a single plate and bent or affixed to provide mixing and conditioning of the flowing media. Single tabs or tab pairs emanating from common vertices can be formed so that they diverge in, or against, the direction of flowing media. The flow conditioner requires as little as three pipe diameters downstream and upstream to mix and condition the flow stream allowing close placement to elbows, valves, tees, and other disturbances typically seen in industrial plants.

15 Claims, 18 Drawing Sheets

FLOW MIXER AND CONDITIONER

FIELD OF THE INVENTION

The invention relates generally to devices that mixes or conditions, or both, media flowing within a conduit, and more particularly, to devices to be used upstream from flow meters, pumps, compressors, reactors, or other critical equipment requiring a uniformly mixed, swirl-free, symmetric, reproducible, and destratified velocity profile regardless of upstream stratification, flow distortions, disturbances, or anomalies.

BACKGROUND OF THE INVENTION

Disturbances in media flowing within a conduit adversely affect flow meter performance and pump protection by creating, for example, swirl and irregular flow profiles. The resulting errors often exceed the flow meter manufacturer's published accuracy specifications and can lead to cavitation and excessive pump component degradation. Flow conditioning, such as may be accomplished by tube bundles or perforated plates, among others, is known within the prior art to remove swirl and create symmetric and reproducible velocity profiles for media such as liquids, steam, gases, air, vapors, or slurries, and the like, flowing within a conduit. Flow conditioning should also destratify non-uniform media. Velocity profiles that can benefit from flow conditioning include those that are irregular due to disturbances caused by passing through or near obstacles, such as variable valves, bends, blockages, or junctions that create arbitrarily varying flow characteristics. Examples of prior art flow conditioners are described in U.S. Pat. Nos. 4,929,088 and 4,981,368. Additional prior art flow conditioners may have tube bundles, perforated plates, or other baffle arrangements.

FIG. 1 illustrates a prior art flow conditioning device 10 of the type described by U.S. Pat. Nos. 4,929,088 and 4,981,368. This flow conditioner is an assembly that is mounted into a pipe or duct and contains tabs 17 that are angled inwardly in the direction of flow as indicated by arrow A. This device requires a distance of several pipe diameters (typically about six diameters) to properly condition the media flowing within a conduit after passing a plane of flow disturbance 15, FIG. 1 illustrates the six diameters typically required as two distinct distances 12 and 13, each being three diameters. Therefore, media flowing in the duct having flow distortions occurring at a plane of disturbance 15 that is some distance 11 upstream from flow conditioning device 10 can be conditioned by device 10 to have a desired profile when reaching a device such as a pump, or a flow meter 19, or any other device that requires the flowing media to be free of undesired flow profiles and stratification.

There are numerous types of flow distorting devices that can create a plane of flow disturbance 15 including, but not limited to, elbows, bends, junctions, or areas not having a common plane with the conduit. Flowing media needs to travel a distance of several diameters of conduit as shown by distance 13, for the anti-swirl action, vortex generation and annihilation, or settling to take place. This distance is required for the settling to occur downstream of a flow conditioner to insure proper conditioning of the flowing media. Flowing media needs to be properly conditioned before reaching a pump, flow meter, or any other device that requires mixing or destratification. As used herein, "destratification" is the process of mixing either gaseous or liquid substances, or the like, together to eliminate stratified layers of any kind be it temperature, density, concentration, chemical, or diverse media, for example. Further, minimum distorted and uniform flow profiles are very important in pumps where destructive cavitation is a problem, or where stratified or asymmetrical flow rate profiles are present.

Flow conditioning devices, such as shown in FIG. 1, that are used for conduits having sizes above about six inches in diameter are heavy, expensive to ship, and require expertise to handle and install. This situation becomes increasingly more difficult and costly as the size of the conduit, and therefore, the conditioner device, increases in diameter.

Additionally, "floor space" is extremely valuable in particular implementations, such as offshore oil platforms for example. Volume as well as area are important on board ships or aircraft, or inside the containment building in nuclear power plants, all of which have a strong need to minimize straight runs of conduits ("floor space/volume"). In response to this need, the device 20 of FIG. 2 was developed to reduce the problem of long run lengths of conduit that have been required for flow conditioning. This is an illustration of another prior art flow conditioner which at least reduced, but has not completely eliminated, the problem.

Other flow conditioning devices include tube bundles, which do not correct the velocity profile distortion, and perforated plates, which are useful but tend to cause excessive pressure drop, do little mixing, and are not particularly useful in pump protection.

SUMMARY OF EMBODIMENTS OF THE INVENTION

Various embodiments discussed herein address the shortcomings of the prior art. These embodiments provide improvements over the prior art by reducing, and some instances even eliminating distorted or asymmetric velocity flow profiles and other variable disturbances in flowing media to enable flow meters to have improved accuracy, enhanced mixing, and extended life span of critical process equipment, such as pumps and compressors. These embodiments also improve velocity flow profiles by reducing swirl, reducing stratification, and eliminating random vortices, thereby improving the accuracy of turbine, orifice plate, sonic, thermal, ultrasonic, magnetic, vortex shedding, pitot tube, annular, sonar, differential pressure, and other flow metering devices. Additionally, pumps are protected by mixing and destratifying the flowing media. The term, "meter," will occasionally be employed herein to include each and all of the devices or instruments already enumerated.

Flow disturbances of all sorts can adversely affect flow meter performance by creating asymmetric, unknown, random, or distorted velocity profiles and swirl, or all of these. Embodiments for a flow conditioner in accordance with the invention are disclosed herein that can provide flow meters, pumps, compressors, and other critical equipment a swirl-free, symmetric, and reproducible velocity profile regardless of upstream flow distortions, disturbances, or anomalies. These improvements in flow meter accuracy are accomplished economically and with negligible, or acceptable and minimized pressure drops. The flow conditioner embodiments herein disclosed function well when positioned approximately three pipe diameters in length upstream of the meter to condition the flow stream and can be coupled near elbows, valves, tees, and other disturbances typically seen in industrial plants.

The flow conditioner embodiments disclosed herein are simpler and more effective than flow conditioning devices previously available in conditioning the flow upstream from flow meters and eliminate the need for outside fabrication and weld shops. They also use less raw material, enable flange mounted installation, require less fabrication time, fewer and lower cost shipping requirements, are more acceptable internationally, provide a greater selection of materials, allow for manipulation of design to alter the shape of the velocity profile of flowing media, are more appealing in larger pipe sizes, and eliminate non-destructive testing requirements typically applied to pressure holding vessels or weld seams.

In comparison with some prior art devices, embodiments of flow conditioners disclosed herein may only require one sheet of material, typically round, to conform to the inside topography of the conduit with the outline of the tab design laser cut into it. These flow conditioners/mixers require no constructional welds. The outline of the flow profile conditioning tabs can be laser cut onto the sheet then bent to position. Any other suitable cutting process can be used, including but not limited to, water jet, plasma, among others. Because there are no welding requirements, the embodiments disclosed herein can be completely fabricated in a single work center. Depending on the final design, only one to three profile tab punching tools will be required to bend all the internal profile conditioning tabs. An additional punch may be required to bend the circumferential tabs, as will become clear below.

Embodiments of the present flow conditioner utilize tabs bent into the flow stream to create vortices, which cross-mix as they propagate downstream. Altering the degree of pitch on any of the tabs will produce changes in the velocity profile and its effectiveness. This could allow the possibility to "tailor make" the actual shape of the velocity profile by altering the pitch, shape, location, and number of individual tabs, combinations of tabs, or all the tabs.

The embodiments disclosed herein require no welding and therefore are not subject to radiograph, ultrasonic, liquid dye penetrant, or any other non-destructive examinations typically used in weld zones. Since these flow conditioning devices are not a pressure holding device, hydrostatic pressure checking of the finished product is not required.

Embodiments discussed herein comprise a plate with outlines cut into the plate to delineate tabs that can be bent away from the plate. The tabs are then bent to be sloped or inclined with respect to the plate so that the trailing edges of the preferred shape of each tab or pair of tabs are inclined to diverge in a downstream direction with respect to the plate. The plate can then be used as a flow conditioner for media flowing within the conduit. A simple plate could also be constructed to have some tabs bent upstream as well as downstream, or all the tabs could be bent in the upstream direction.

Flow conditioners having tabs formed in a plate so that they diverge in the flow stream direction provide more effective and more easily implemented flow conditioning for isolating flow disturbances and creating an optimal and repeatable velocity profile at the flow metering location and tend to be self cleaning.

Embodiments according to the invention for flow conditioner plates having tabs projecting in the flowing media can be fabricated using less material, with less fabrication time, and eliminating the need for all welding that would be required using prior art flow conditioners. Furthermore, these embodiments weigh less and are smaller in size resulting in lower shipping costs.

Flow conditioners made from plates with diverging tabs are more acceptable to alternative materials of construction including plastics and resin encased fibrous combinations such as fiberglass and fiber re-enforced plastics.

Altering the degree of pitch on any of the tabs will produce changes within the shape of the velocity profile immediately following the tabs and continuing as the velocity profile propagates downstream.

By providing plate-like elements that are processed by, for example, a laser to cut a series of tabs, the tabs being bent into the flow stream, embodiments of the invention have resulted in an improved flow conditioner and mixer. In one particular embodiment, tabs are formed so that several pairs of tabs diverge in the downstream direction.

Improved performance and protection in flow measurement instrumentation, pumps, compressors, protection devices, sampling devices, and other critical process components can be achieved by installing as few as one of the plate-like elements described herein, typically upstream, but occasionally downstream, from critical process components.

The terms, "plate," or "plate-like elements," as used herein, refers generally to an element that is flat, concave, convex, uneven, or any combination thereof, having a surface in which a plurality or a multiplicity of tabs are formed and bent into the flow stream. The outer defining boundary of such "plate" may be round, oval, rectangular, or multi-angular, or any other shape that is appropriate to accomplish the intended purpose within a conduit.

The embodiments of the invention described herein perform as well as or better than the prior art devices in terms of mixing, conditioning, destratification, or pressure drop, or all of the preceding. These embodiments are less costly to make and own than either the FIG. 1 or FIG. 2 devices, including handling, shipping, installation, labor, material, storage, maintenance, cost of purchase, and use of floor space or volume, as noted above.

Some embodiments described herein provide for a reduction in size of vortex generating tabs that is possible by using an increased number of tabs. The tabs are plate mounted and can be arranged to provide a cross section within a conduit having tabs distributed across the cross section that the media must flow through.

Differing embodiments may vary the angles with which the tabs diverge. Varying embodiments can adjust the area of the support structure on the plate from which the tabs are formed to reduce pressure drop in the flowing media.

Embodiments are disclosed for maximizing the open areas between tabs, and for altering the shape of tabs, so that pressure drop can be reduced. It should be noted that pressure drop is a performance feature in flow conditioners and mixers that must be taken into account. The cost associated with energy used in a conditioner or mixer must be considered and can easily exceed the cost of a flow conditioner in a one-year period of time by the power needed to overcome the pressure drop.

Additional embodiments may have rounded the edges of the support structure on the upstream side or unneeded supports may be reduced to reduce pressure drop.

Embodiments discussed herein combine the compact nature of perforated plates with the effectiveness of both the FIG. 1 and FIG. 2 devices. Some of these embodiments include a multitude of smaller vortex generating tabs causing micro-chaotic mixing and mutual annihilation of the small counter rotating vortices caused by the tabs. The result is a uniform mix or a predictable downstream flow profile, or both, regardless of upstream flow disturbances or mixing conditions. These embodiments perform the desired functions of destroying any undesired residual upstream conditions using a shorter pipe length due to the larger number of smaller tabs distributed across the flowing media than is possible with either of the devices of FIG. 1 or FIG. 2. These embodiments of the invention may be thought of as devices that cause organized chaos or thorough mixing in a shorter, more compact distance and configuration than was previously possible and at a reduced pressure drop and lower cost of ownership.

Some embodiments discussed herein also provide additional advantages over the prior art by employing a flat plate requiring no welded construction, and generating vortices that mix media to eliminate stratification and reduce or erase the effects of upstream causes of instrument flow rate measuring errors. These embodiments are superior to some prior art devices in protecting pumps from cavitation and stratification due to the shorter distance of as little as three diameters between pump inlet and flow disturbances.

By requiring no welding to form the structure of the plate, embodiments of the invention increase international marketing potential because welding protocols pertinent to individual countries will not apply. This includes welder's certifications, welding procedures, weld maps, boiler code requirements, and others.

The flow conditioning device illustrated in FIG. 1 is typically three pipe diameters long and requires custom shipping containers. Sizes greater than about six inches in diameter typically require custom-built wooden crates for shipping. Embodiments of the flow conditioners presented herein can provide as much as a tenfold reduction in shipping costs.

Materials used in construction of flow conditioners have typically included stainless steel and carbon steel. The embodiments of the present invention disclosed herein can be comprised of these, as well as other metallic materials, plastics, fiber re-enforced plastics (FRP), and other non-metallic materials, again at substantial savings in shipping and material costs.

BRIEF DESCRIPTION OF THE DRAWING

The purposes, advantages and features of the invention will be more clearly understood from the following detailed description, when read in conjunction with the accompanying drawing wherein.

DETAILED DESCRIPTION OF EMBODIMENTS OF THE INVENTION

Figure 1:
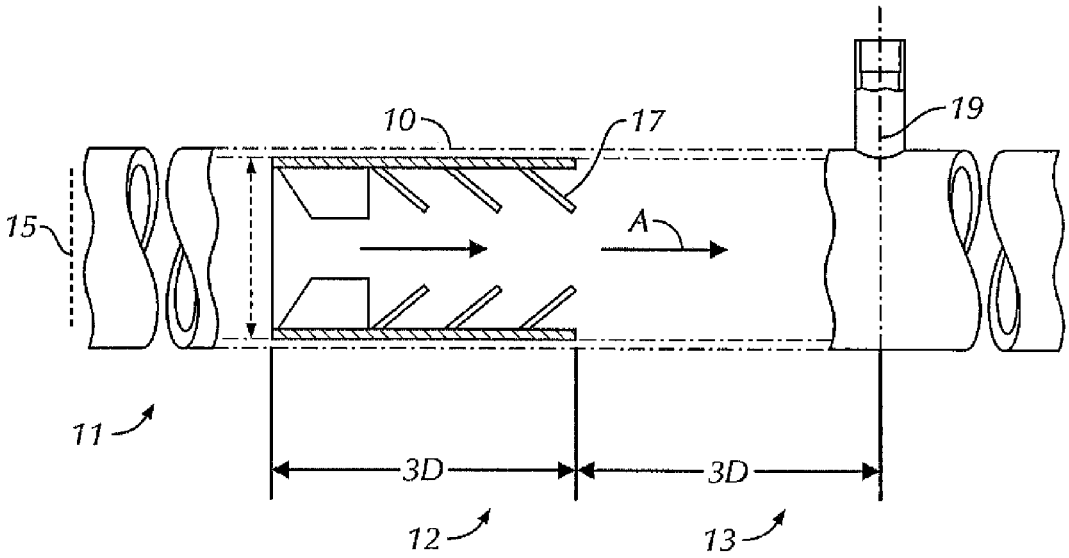
FIG. 1 (Prior Art)
FIG. 1 is a partial sectional view illustrating a prior art flow conditioning device.
Figure 2:
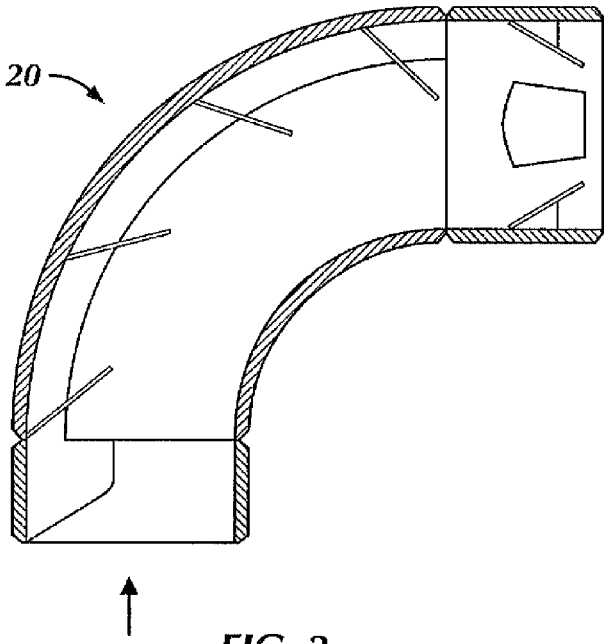
FIG. 2 (Prior Art)
FIG. 2 is a sectional view of another prior art flow conditioning device.
Figure 3:
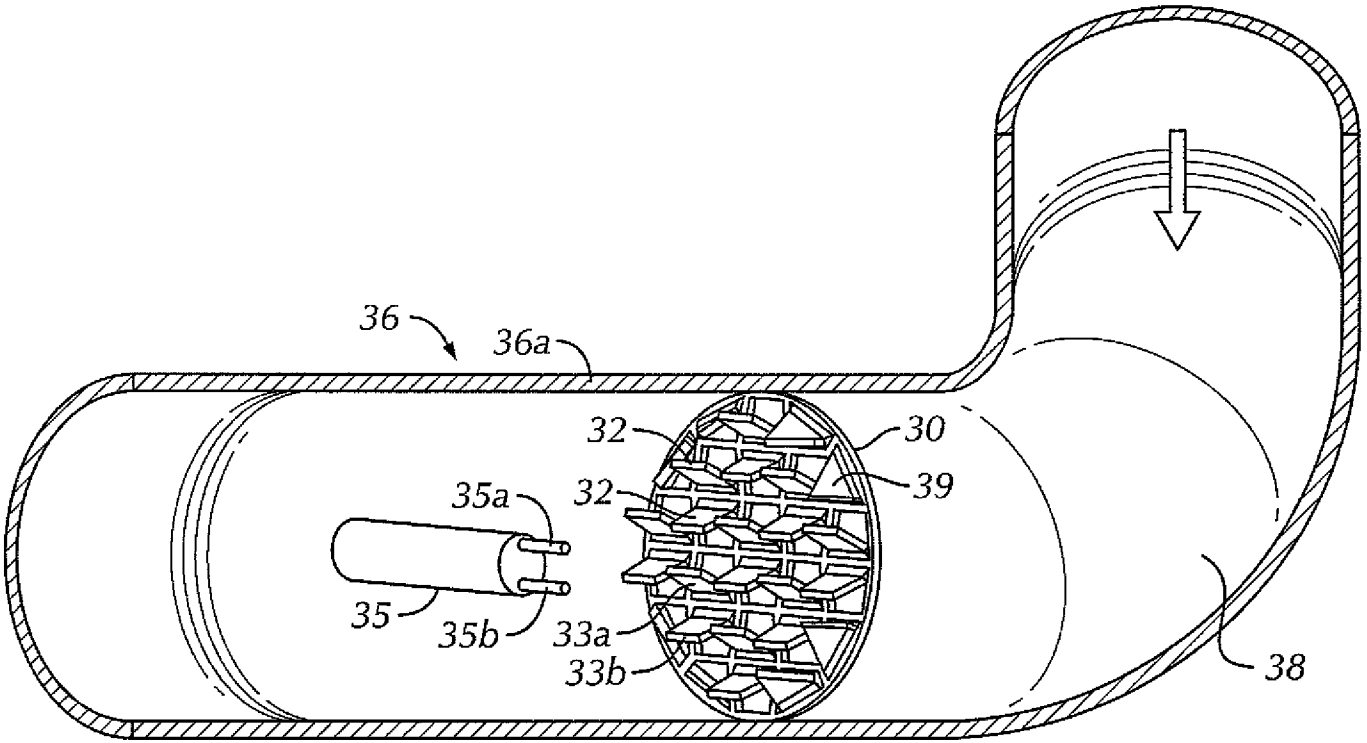
FIG. 3 is a schematic pictorial diagram illustrating a typical installation for an embodiment of the flow conditioning device according to the invention shown upstream from a typical insertion point flow meter.

With reference now to the drawing, and more particularly to FIG. 3, there is schematically shown a pictorial embodiment of the invention with flow conditioning plate 30 having tab pairs 32 comprising tabs 33*a*, 33*b* that diverge from common vertices in the downstream direction, and circumferential tabs 39. FIG. 3 illustrates a typical installation of flow conditioning plate 30 positioned in conduit 36 and flow element instrument or meter 35 is located in a typical position downstream from the flow conditioning plate. A single elbow 38 is located upstream from the flow conditioning plate and this can be the cause of at least some flow disturbances.

It is contemplated that plate 30 will be generally arranged perpendicular to the direction of media flow, but there is no requirement that it be so oriented. Normally instrument 35 extends through wall 36*a* into the center of media flow conduit 36. However, sensing elements 35*a* and 35*b* may be positioned other than in the center of the conduit, as appropriate for the flow conditions at that location.

Various embodiments are envisioned for rotating the orientation of the tabs 33*a*, 33*b* and 39 with the intention of benefiting downstream instrumentation or other critical process equipment. Furthermore, the thickness of the flow conditioning plate can be modified to support alternative effectiveness and to meet otherwise unforeseen situations.

Figure 4B:
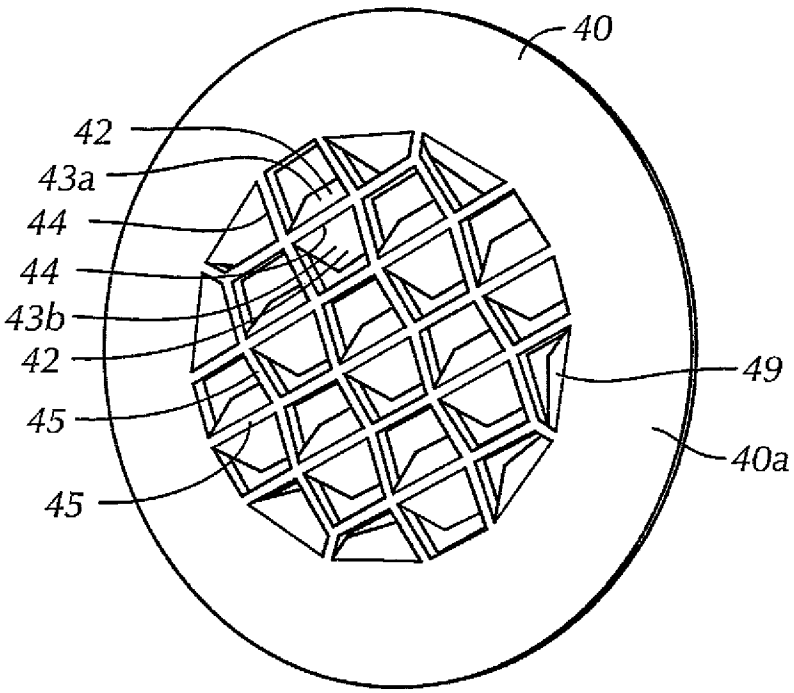
FIG. 4B is a perspective view of an embodiment of the FIG. 3 device viewed from the upstream side.
Figure 4A:
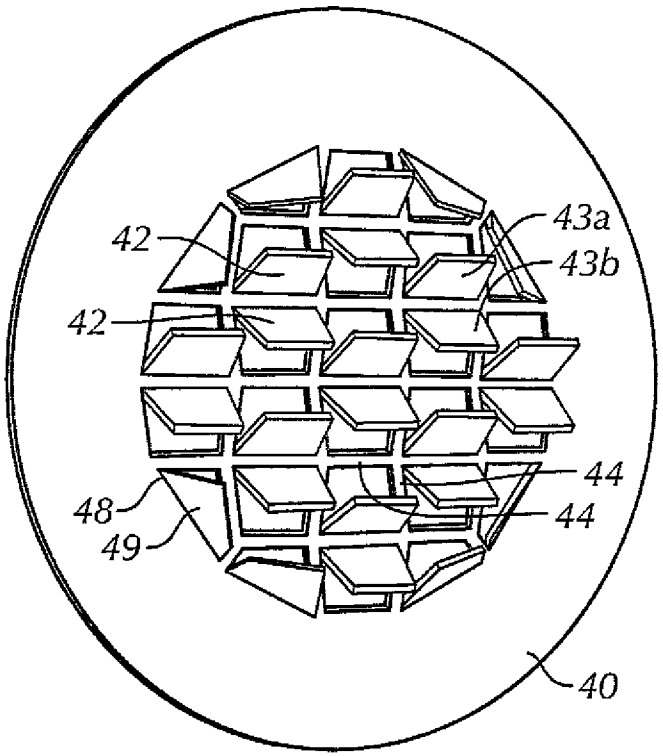
FIG. 4A is a perspective illustration of an embodiment of the FIG. 3 device viewed from downstream.

FIG. 4A is a view of the downstream side of flow conditioning plate 40. This flow conditioning plate is intended to be placed within a conduit that has fluid media, either liquid or gaseous, or a slurry, or a combination of any of these, flowing in a direction from upstream to downstream. Flow conditioning plate 40 has a plurality of tab pairs 42 comprising tabs 43*a*, 43*b* formed to be inclined from common vertices 44. Vertices 44 constitute the framework which supports the tabs formed in the central portion of the plate. Tabs 43*a*, 43*b* diverge from vertices 44 in the flow conditioning plate in the downstream direction. Tabs 43*a*, 43*b* may be formed from shapes that are essentially square, rectangular, triangular, elliptical, quadrilateral, or arcuate in shape, or any combination thereof. The tabs can be pierced to permit flow through the pierced tabs and tab edges maybe scalloped or otherwise shaped, as discussed below.

FIG. 4B is a view of flow conditioning plate 40 from the upstream side. Once flow conditioning plate 40 is placed within a conduit, it can condition flowing media within the conduit. FIG. 4B shows the back side of the plurality of tab pairs 42 with tabs 43*a*, 43*b* inclined from common vertices 44 diverging in the downstream direction.

FIGS. 4A and 4B illustrate an embodiment having nine tab pairs 42 resulting in 18 tabs 43*a*, 43*b*. Additionally, there are eight generally pentagonal or triangular circumferential tabs 49 that are formed in plate 40 as shown here. In the embodiment shown in FIGS. 4A and 4B each of circumferential tabs 49 has bending vertices 48. Note that FIGS. 4A and 4B illustrate a single embodiment. Other embodiments that have varying numbers of tab pairs 42 or circumferential tabs 49 are also envisioned. Other embodiments entirely omit individual tabs 43*a*, 43*b*, or circumferential tabs 49. While FIGS. 4A and 4B illustrate circumferential tabs 49 that are generally shaped as pentagons, the circumferential tabs can be formed from varying shapes such as square, rectangular, triangular, elliptical, quadrilateral, or arcuate, or combinations thereof, as well as pierced or scalloped as above. Additional embodiments are not limited to any particular number of tabs, tab pairs 42, or circumferential tabs 49.

In FIGS. 4A and 4B, tabs 43*a*, 43*b*, and 49 are spaced symmetrically about the center axis of flow conditioning plate 40. Varying embodiments can space tabs 43*a*, 43*b*, and 49 in different ways. Flow conditioning plate 40 can be affixed to an accepting conduit through various means including, but not limited to, screws, bolts, rivets, weld-in-place, flange mounted, or can be supplied rigidly mounted within a conduit, tube, or piping spool piece. The void area 40*a* between circumferential tabs 49 and the major diameter of plate 40 can accommodate a conventional flange mounting structure. The mounting structure can include cutouts or other modifications.

In an embodiment, the shape, size, and placement of tabs 43*a*, 43*b*, and 49 can be proportional to fluctuations within the receiving conduits such that the ratio of the size of tabs to the size of the conduit remains consistent. This can be accomplished regardless of the receiving conduit size. Further, that ratio can be varied as desired.

In another embodiment, the degree of inclination or angle of bending of tabs 43*a*, 43*b*, and 49 can be varied between about 0° and about 80° with respect to plate 40, depending on the desired results. The tabs can be configured to all have the same inclination or each of the individual tabs can have its own specific inclination. Specified combinations of tabs 43*a*, 43*b* and 49 can maintain a specific inclination while others of the tabs can have different degrees of inclination.

Embodiments as described herein have numerous advantages over prior art flow conditioning devices. Forming tabs in a plate so that they diverge in the flow stream direction results in a mixing of the flow stream by creating streamwise vortices of sufficient strength, spacing, and orientation to enhance the flow mixing process. This is a static mixing process that promotes the efficient circulation of fluid, both toward and away from the bounding surface (that is, the conduit), which enhances not only fluid mixing, but also increases momentum and energy transport within the media as well as increasing the transfer of heat to or from the bounding surface by the flowing media. Embodiments with tabs that diverge in the downstream direction also encourage mixing of the velocities (momentum), the kinetic energies, the fluid temperatures, pressure gradients, densities, and the transported species. In other words, the embodiments described herein are effective in destratifying the media for any and all mixing purposes.

Figure 5A:
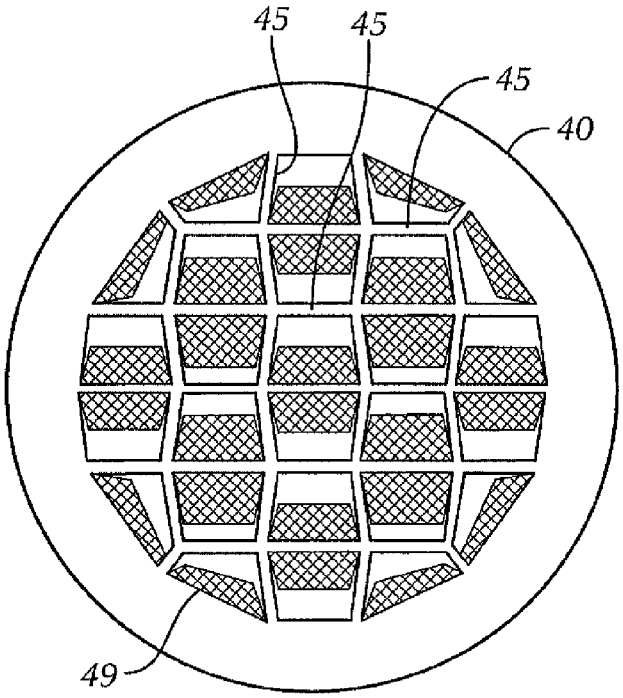
FIG. 5A is a plan view of the embodiment shown in FIG. 4A and FIG. 4B.
Figure 5B:
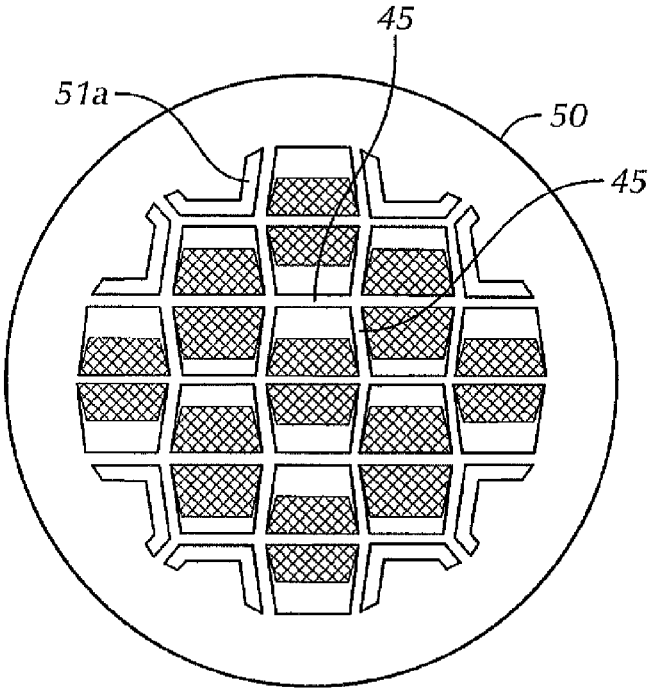
FIG. 5B is an illustration of an alternative embodiment to that shown in FIG. 5A.
Figure 5C:
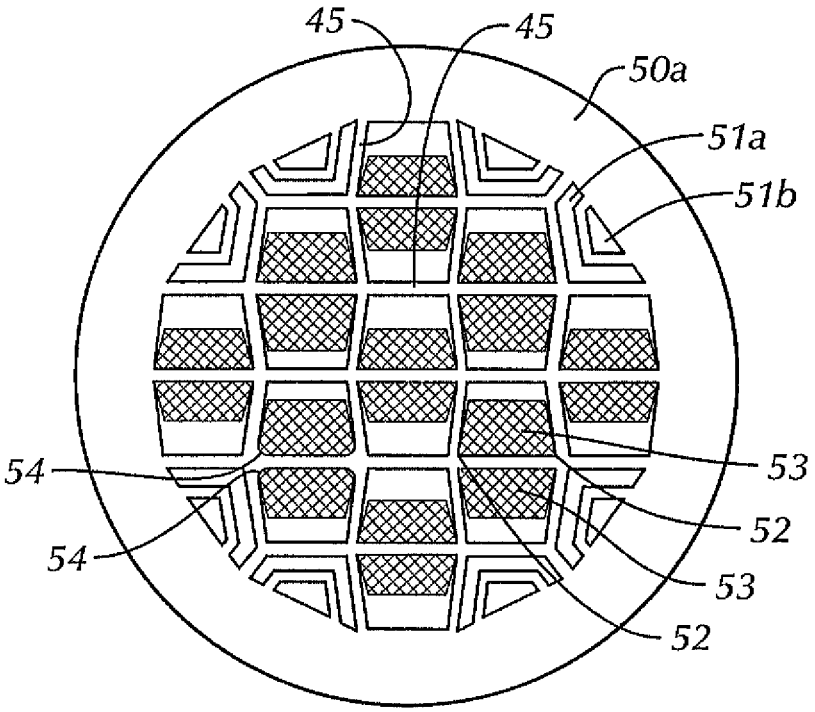
FIG. 5C is an illustration of another alternative embodiment to that shown in FIG. 5A.

FIG. 5A is a top view of the flow conditioning plate of FIGS. 4A and 4B after the tabs have been bent. FIGS. 5B and 5C show alternative embodiments, with flow conditioning plate 50 having cutouts 51*a* in FIG. 5B, and plate 50*a* having additional cutouts 51*b* in place of the circumferential tabs in FIG. 5C. The vortex producing cutouts 51*a* and 51*b* in these embodiments are configured to eliminate the need to bend the circumferential tabs, thus reducing fabrication time and still providing the flow conditioning benefits. Other embodiments may include the bending of the tabs formed by cutouts 51*a* and 51*b*. The tabs can be formed to have rounded corners which can greatly improve material fatigue and stress. Varying embodiments can decrease the length of the tabs that are bent to increase the open area and reduce pressure loss. Also the shape of the tabs can be designed to optimize the remaining structure of the plate to further reduce pressure loss.

High stress concentration areas 52 in FIG. SC inevitably occur in the junctions where tabs 53 are bent from plate SOA. Small radii 54 can be incorporated to reduce stress concentration that would otherwise be present if the tabs ended in sharp corners. Further, any otherwise sharp corners can be rounded, such as radii 54, to reduce stress.

Figure 5D:
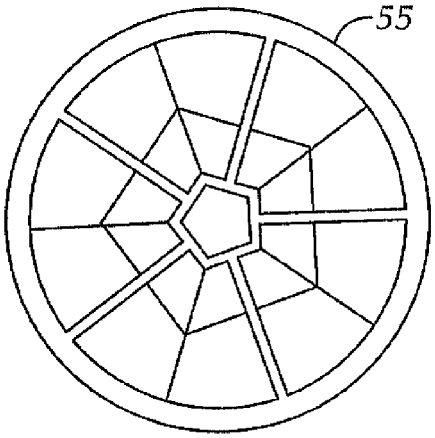
FIG. 5D is an illustration of another alternative embodiment to that shown in FIG. 5A before tab bending.
Figure 5E:
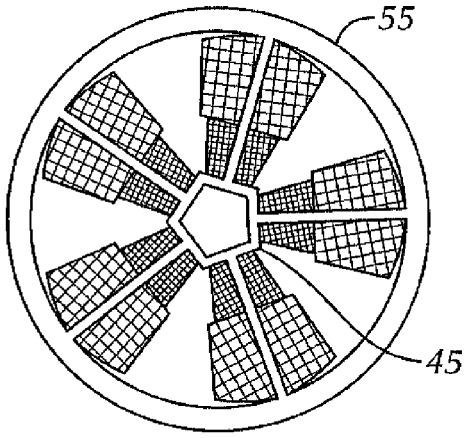
FIG. 5E shows the tabs from FIG. 5D in the bent position.
Figure 5F:
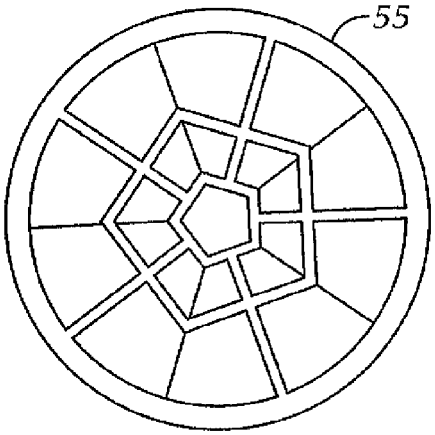
FIG. 5F is an illustration of another alternative embodiment to that shown in FIG. 5A before tab bending.
Figure 5G:
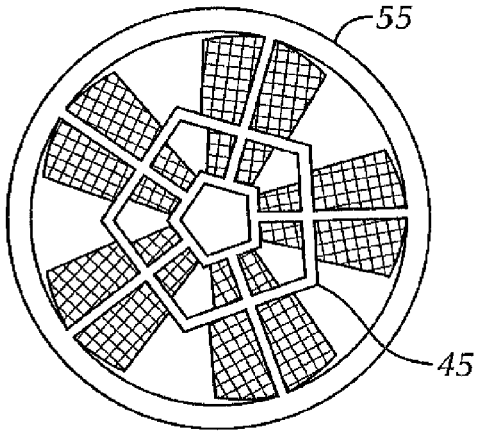
FIG. 5G shows the tabs from FIG. 5F in the bent position.
Figure 5H:
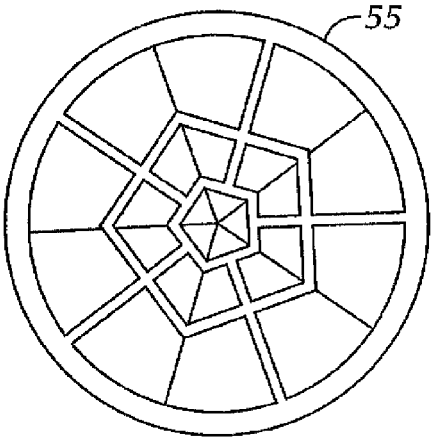
FIG. 5H is an illustration of another alternative embodiment to that shown in FIG. 5A before tab bending.
Figure 5I:
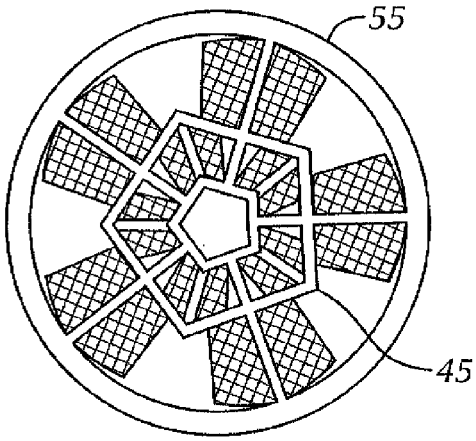
FIG. 5I shows the tabs from FIG. 5H in the bent position.

Examples of alternate embodiments include, but are not limited to, symmetrical configurations such as those shown in FIGS. 5D through 5I. FIGS. 5D, 5F, and 5H exhibit tab patterns cut into base plate 55 prior to tab bending, while FIGS. 5E, 5G, and 5I show the plates of FIGS. 5D, 5F, and 5H, respectively, after the tabs are bent into place.

Once the tab pairs are bent in any of the flow conditioner 30, 40, 50, 50A, and 55 embodiments, there is a grid formed with grid members 45 remaining from where laser cuts were made to form the tab pairs. These grid members provide strength and structural integrity to the flow conditioners. Grid members 45 also provide for vortex generation. These grid members may be made of various widths, with narrower members providing a reduced pressure loss and vortex generation variations.

Figure 6A:
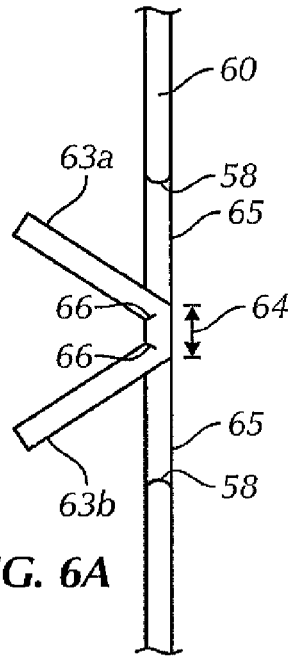
FIG. 6A is an illustration of a tab pair being formed in a plate.
Figure 6C:
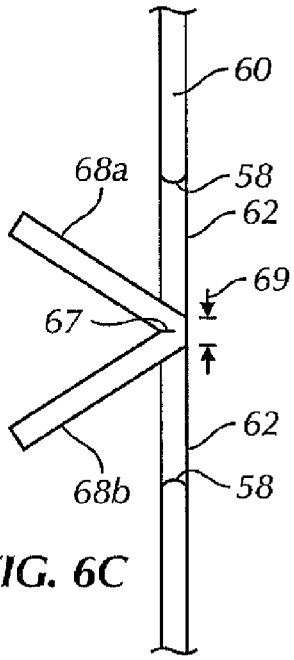
FIG. 6C is a view of an alternative embodiment for forming a tab pair in a plate.

Various manufacturing methods are envisioned for cutting of plates to produce previously discussed flow conditioners 30, 40, 50, 50A, and 55, as well as other embodiments for flow conditioners. Laser, water jet, and plasma, among others, have been mentioned previously for cutting plates as required. Optional methods are shown in FIG. 6. Referring to FIGS. 6A and 6B, plate 60 has complete through-cuts made to create tab pairs 63*a*, 63*b*. Tab pairs 63*a*, 63*b* are bent from plate 60 such that they diverge, preferably in the downstream direction. Grooves 66 can be made partially into plate 60 to assist in bending the tab pairs from the plate. Complete through-cuts 61*a*, 61*b* are made through plate 60 to form the farthest downstream edges of tab pair 63*a*, 63*b*. Grooves 66 can be employed to make it easier to bend tabs 63*a*, 63*b* from plate 60 after complete through-cuts 61*a*, 61*b* are made.

The flowing media will flow through spaces 65 from which the tab pairs were cut. The flowing media traverses through spaces 65 and onto the tabs which forces the flowing media into divergent streams. The edges and corners of tab pair 63*a*, 63*b* will create vortices within the flowing media that force mixing of the media, thereby reducing stratification. There is a direct blockage to flow of the media by area 64 that remains in a plane parallel to plate 60. This is essentially a grid member 45 as previously described. In general, each opening will have an associated tab, but there can be some openings without a tab.

Figure 6E:
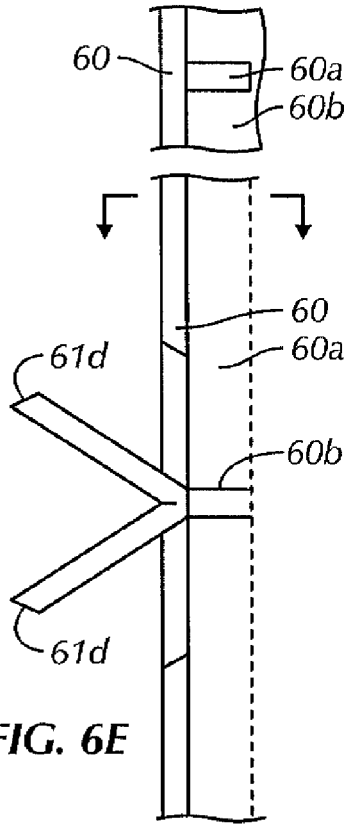
FIG. 6E illustrates an alternative tab shape, with optional structural reinforcement stiffeners.
Figure 6B:
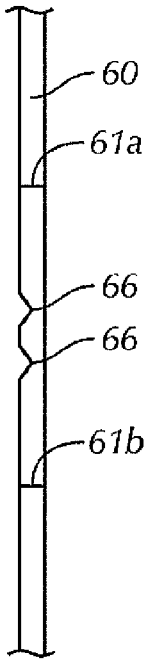
FIG. 6B is an illustration of the plate of FIG. 6A with cuts made to form the tab pair.
Figure 6D:
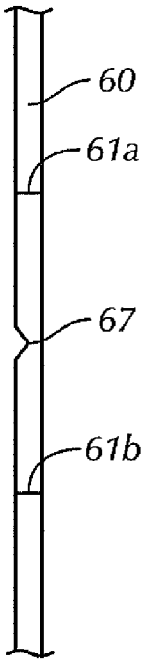
FIG. 6D shows the plate of FIG. 6C with cuts made to form the tab pair.
Figure 6F:
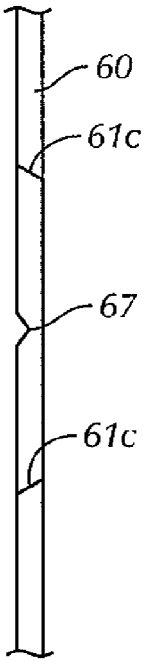
FIG. 6F shows the plate of FIG. 6E with cuts made to form the tab.
Figure 6G:
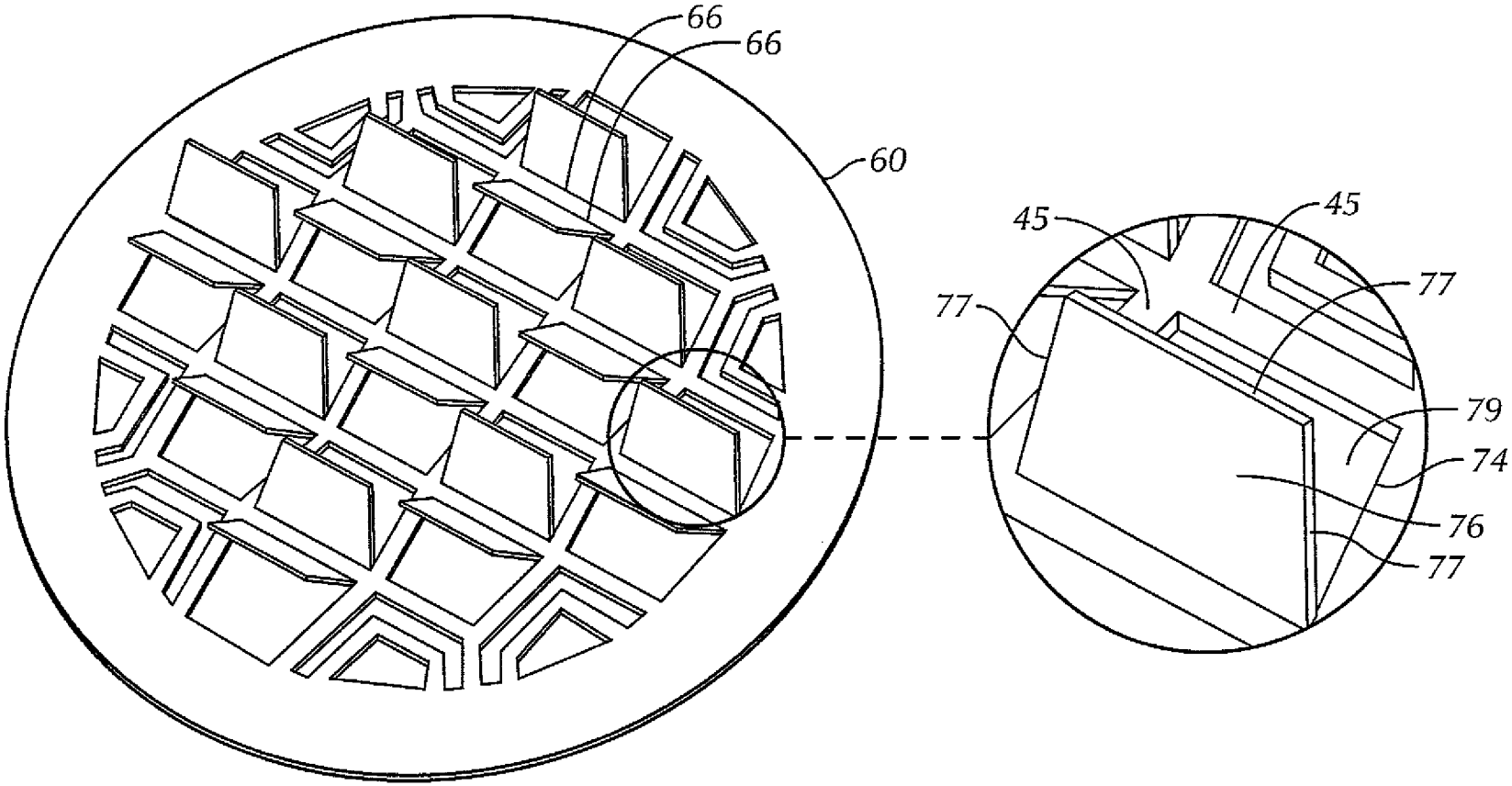
FIG. 6G is a perspective illustration of FIG. 5C, showing a blow-up of one in-position tab.

FIG. 6G shows a completed plate 60 made according to the FIG. 6B embodiment, with an enlarged partial view of a tab in position, viewed from a downstream perspective with grooves 66 called out. The FIG. 6G enlargement shows tabs 76, grid members 45, tab edges 77, opening edges 74, and orifice or opening 79. Numerous different embodiments are envisioned for providing assistance in bending of tabs, including making smaller, larger, more, or fewer grooves. Mechanisms other than grooves are also envisioned which can be used to remove material from plates to assist in bending the tabs. While the tab corners are shown in FIG. 6G as sharp they can be rounded as described FIG. 5C.

In another embodiment, as shown in FIG. 6D, grooves 67 are formed in portions of plate 60 to assist in bending the tabs. Groove 67 is formed on the downstream side of plate 60. Complete through-cuts 61*a*, 61*b* are again used to cut the edges of the tabs. FIG. 6C shows the resulting tab pair 68*a*, 68*b* that is created by bending down the through-cut tabs and opening up spaces 62 within plate 60. The direct blockage to flow of the media from area 69 is significantly less than is area 64 shown in FIG. 6A.

An alternative shape-forming process for the tabs is shown in FIGS. 6E and 6F. Cuts 61*c* are made at a small angle in plate 60 to result in beveled edges 61*d*. This altered edge shape can reduce pressure drop. Tabs can also be bent without utilizing grooves or other mechanisms previously mentioned. FIG. 6E also shows optional reinforcing stiffeners 60A and 60B which may be employed if and as desired. FIG. 6E includes a schematic end view in the direction of arrows 70 and, since the stiffeners are optional, they are not shown in FIG. 6F.

Referring to FIGS. 6A, 6B, 6C and 6D, embodiments are envisioned in which edges 58 of the structural grid of plate 60 are rounded, and such a configuration is shown in FIGS. 6A and 6C. This aids in reducing pressure loss in the media flowing through spaces 62. There is a trade off that is made in forming rounded edges 58 to reduce pressure loss in that rounding off the sharp corners could affect vortex generation and thereby affect the resulting mixing/conditioning. Typically, this trade off is acceptable because the vortex generation occurs more from the edges and corners of tab pairs 63*a*, 63*b* and 68*a*, 68*b*, and not as much from the grid that remains in plate 60 after the tabs are bent.

In other embodiments, the edges of the tabs themselves can be slightly rounded to effect reduced pressure loss. Here again, there is a trade-off with vortex generation. In applications requiring more through pressure and that require less destratification, this trade-off may be worthwhile.

Figure 7A:
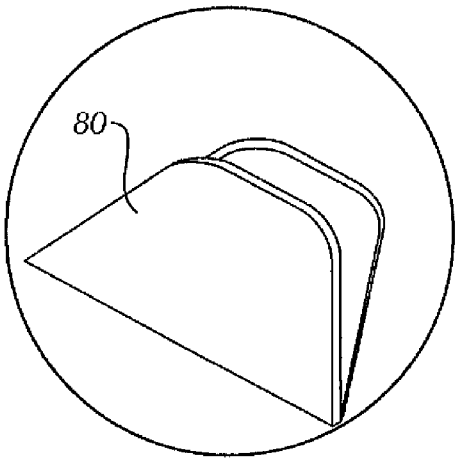
FIG. 7A shows an alternative embodiment for the shape of a tab.
Figure 7B:
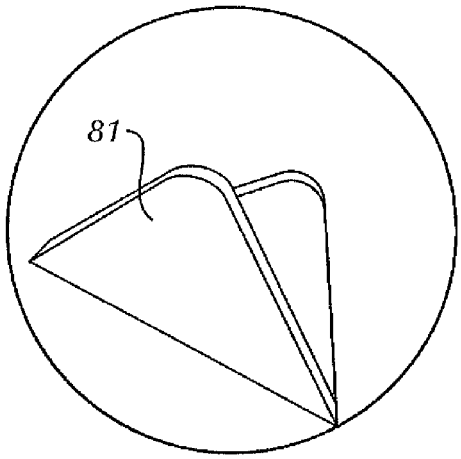
FIG. 7B shows yet another alternative embodiment for the shape of a tab.
Figure 7C:
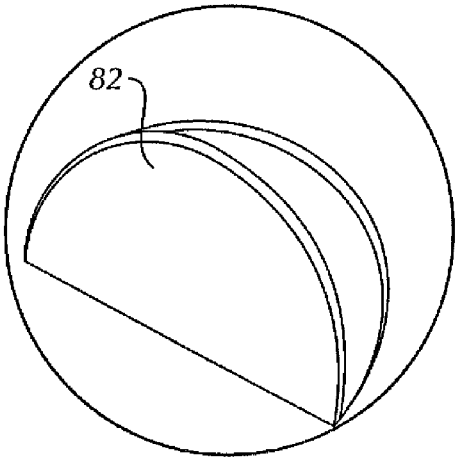
FIG. 7C shows still another alternative embodiment for the shape of a tab.

The tabs, which are shown in pairs, can be made to have any desired shape. For example, in FIG. 7A, tab corners 80 are substantially rounded rather than being generally sharp, as shown in earlier figures. FIG. 7B shows tab 81 as having an oval shape and tab 82 in FIG. 7C is arcuate. Any other shape or combination of shapes can be employed. Since they are contemplated as being laser cut from sheet 60, there is no practical limit to the shapes that the tabs may have. Applications may require the utilization of any particular design, or a combination of different shapes on a single design. Shapes can include, but are not limited to, triangular, parabolic, square, spherical, trapezoidal, parallelogram, rectangular, rhomboidal, or any combination or modification to those previously mentioned.

It must also be noted the tabs do not necessarily have to be bent from the parent plate but can be affixed by way of welding processes or other adhesion processes that would bond or fix tabs to the parent plate regardless of material. This would include but not be limited to epoxies, resins, bolts, glues, rivets, resistance welding, laser welding, or welding either manually or automatically by ways of Metal Inert Gas (MIG), Tungsten Inert Gas (TIG), Shielded Metal Arc Welding (SMAW), Gas Metal Arc Welding (GMAW), Flux core, wire, and stick welding processes. Also noted should be that other appendages not necessarily resembling a tab can be affixed to the parent plate. This would include secondary plates or individual components. It should also be noted that the tabs being affixed could exceed the size of the tabs which would normally be cut from and bent into position on the parent plate. In addition, extensions, wings, or other appendages, can be affixed to any part of the tabs to enhance or alter the size or shape of the tabs, which would have been bent from the parent plate. In other embodiments, backing plates, grid member supports, or other structural additions can be used in conjunction with, or can be affixed to, any part of the flow conditioning plate to enhance structural integrity, examples being shown in FIG. 6E.

Figure 8A:
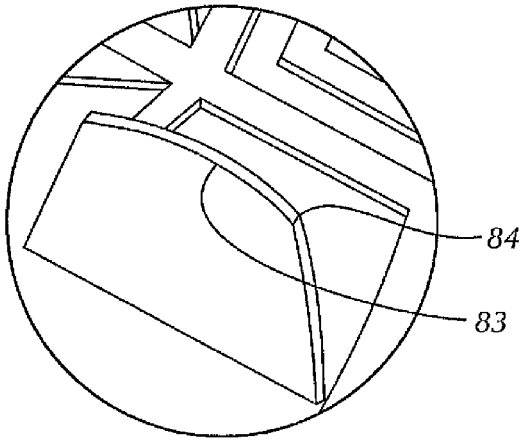
FIG. 8A is a perspective view of a different tab configuration.
Figure 8B:
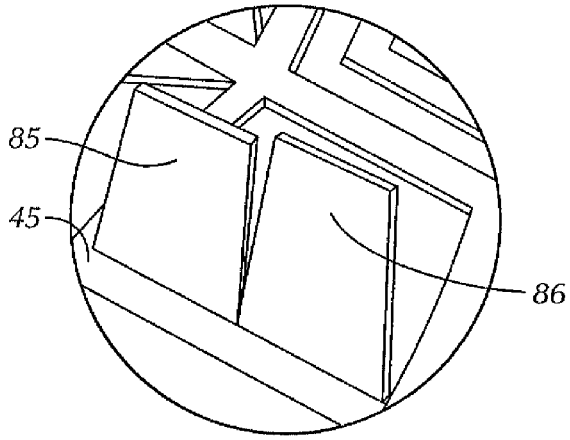
FIG. 8B is a view similar to FIG. 8A, showing an alternative tab arrangement.
Figure 8C:
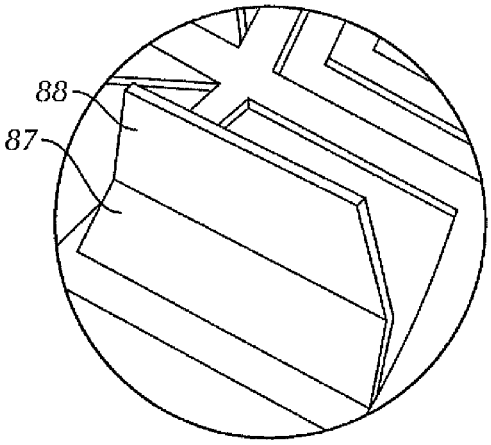
FIG. 8C shows yet another tab configuration.

FIGS. 8A-8C illustrate some examples of tab shapes that are contoured or articulated in various ways. The tab in FIG. 8A is bent so that center portion 83 is not planar with corners 84. This bend could be in either direction and it need not be centered. The tab in FIG. 8B is bifurcated so that section 85 is at a different angle than is tab section 86, in relation to grid element 45. A tab could be split into more than two sections. In FIG. 8C the tab is bent laterally in the middle, resulting in proximal portion 87 and distal portion 88. This bend could be in the opposite direction, or it could be rounded either way rather than having a sharp bend. Other tab deformation embodiments include twisting, folding, or stamping patterns such as the dimples on golf balls. Since the tabs may be laser cut, they may selectively be shortened so the distance they project from grid member 45 can be reduced.

Figure 9A:
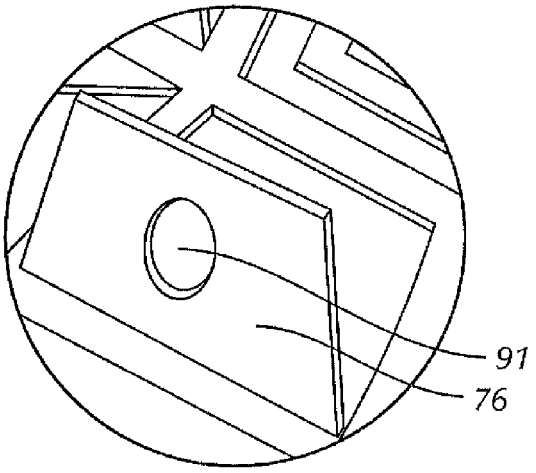
FIG. 9A shows an embodiment of a perforated tab.
Figure 9B:
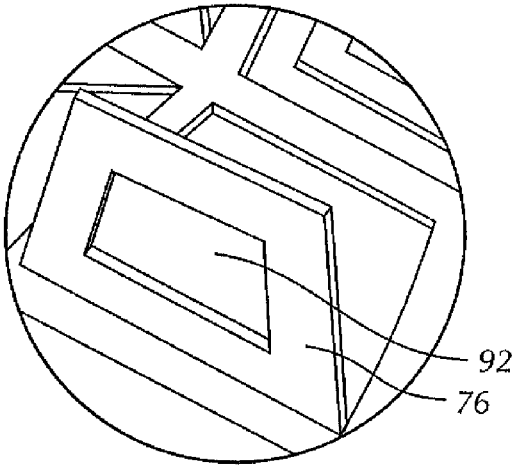
FIG. 9B shows an alternative embodiment of a perforated tab.
Figure 9C:
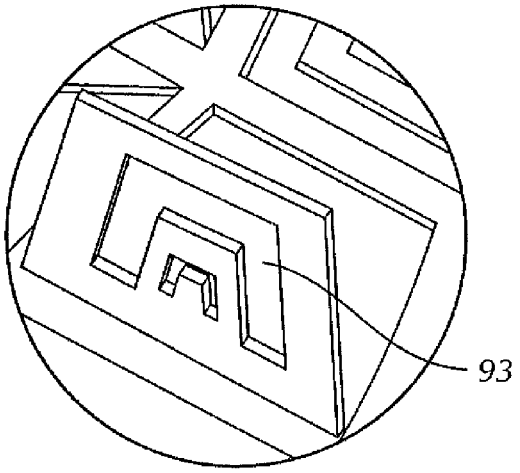
FIG. 9C is yet another embodiment of a perforated tab.

FIGS. 9A-9C illustrate examples of tabs 76 which include cutouts. The cutouts may be single or multiple and can be in the form of round holes, ellipses, stars, geometric shapes, or any combination of cutout shapes. The tab in FIG. 9A has a central hole 91, but it could be located anywhere in the tab, or the tab could be formed with multiple holes. FIG. 9B shows a trapezoidal hole 92 and the tab in FIG. 9C has a combination shaped hole 93. The hole could have any shape, as mentioned above.

Figure 10A:
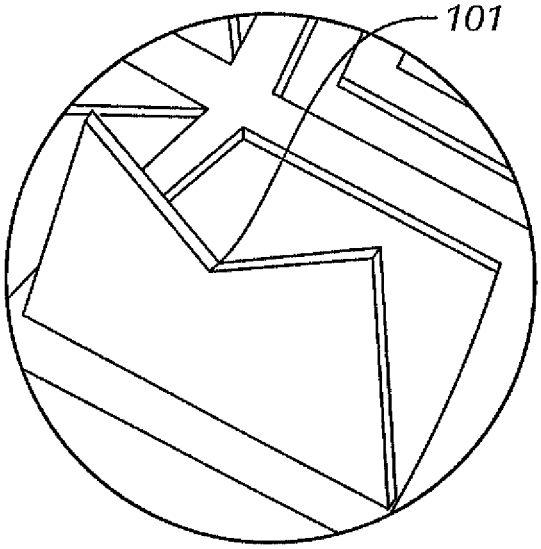
FIG. 10A illustrates a tab with a different edge shape.
Figure 10B:
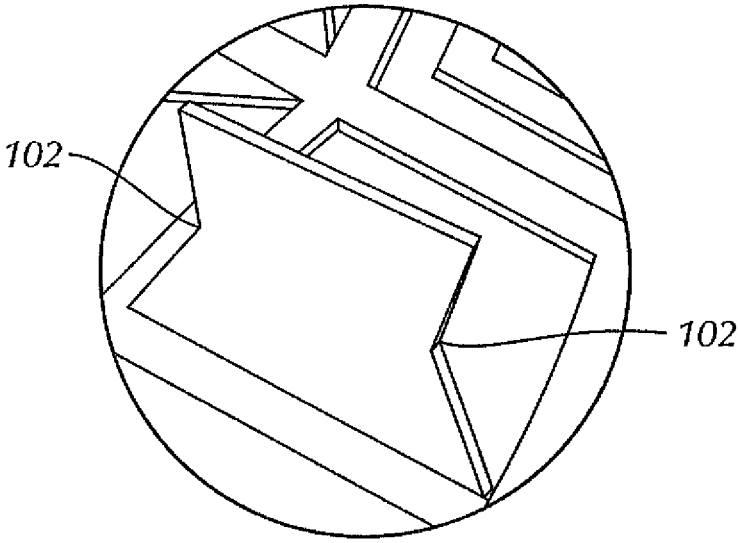
FIG. 10B shows another edge shaped tab.
Figure 10C:
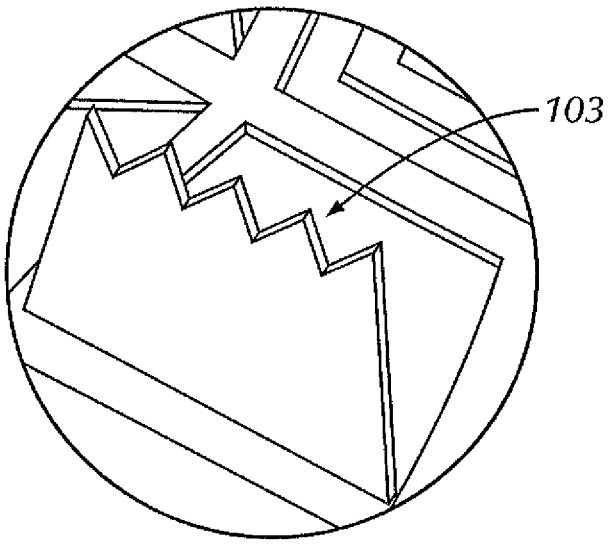
FIG. 10C shows a tab with a sawtoothed top edge.
Figure 10D:
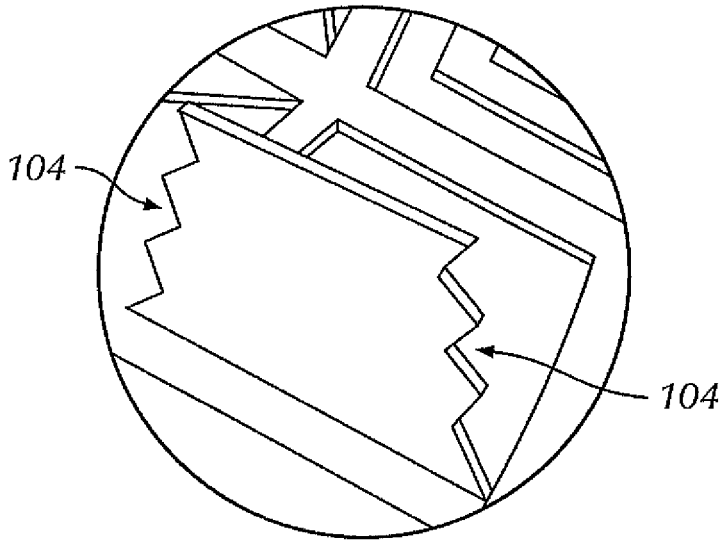
FIG. 10D shows a tab with sawtoothed side edges.

FIGS. 10A-10D illustrate embodiments which enhance the tab edges. Such edges can be formed with sawtoothed, square toothed, rounded, notched, or dovetailed designs, among others. For example, FIG. 10A shows a V-shaped notch 101 in the outer edge of the tab, while FIG. 10B shows symmetrical V-shaped notches 102 in the sides of the tab. A sawtoothed outer edge 103 is shown in FIG. 10C and symmetrical sawtoothed side edges 104 are shown in FIG. 10D. These edges could as well be scalloped or simply notched. Given the ability to make small, precise cuts, there is essentially no limit to the shapes that can be formed on the tabs. Performance can be affected by the different shapes.

It is possible, also, to form embodiments which incorporate different shapes onto grid members 45 and edges 74 that define orifices 79 (see FIG. 6G). Grid members 45 can exhibit sawtoothed, square toothed, rounded, notched, or dovetailed designs, among others. Alternative embodiments allow single or multiple grid members 45 to be removed to reduce blockage from flow plates 30, 40, 50, 50*a*, 55, and 60, for example, thereby preserving pressure in the flowing media. The tab shape need not match or mirror the shape of the orifices 79 as defined by edges 74, and each tab need not be in a single plane, as discussed with respect to FIG. 8.

Figure 11A:
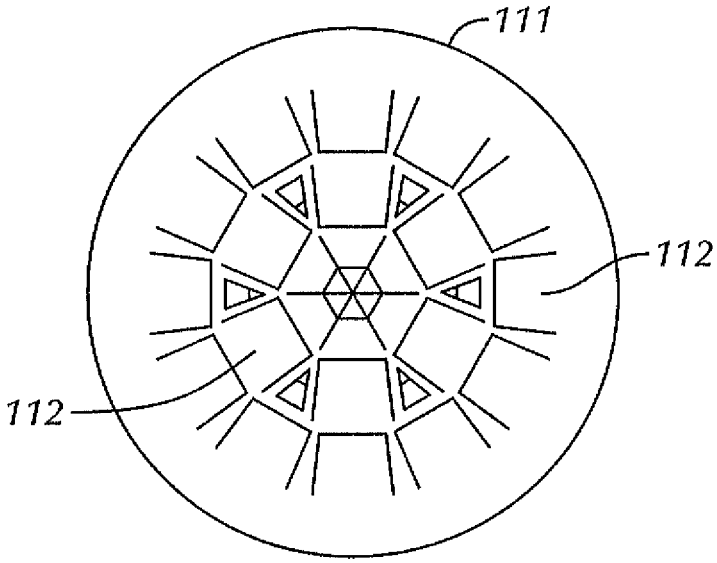
FIG. 11A illustrates a plate with tabs cut but not bent in a different configuration.
Figure 11B:
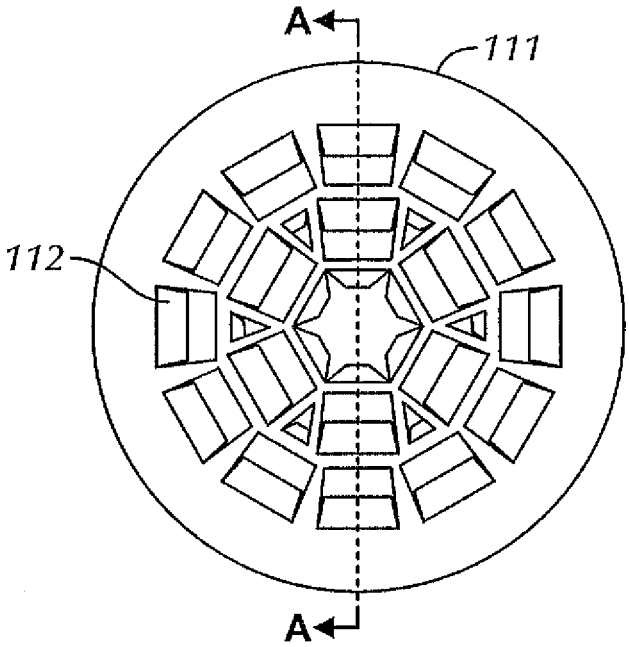
FIG. 11B shows the plate of FIG. 11A with the tabs bent into position.
Figure 11C:
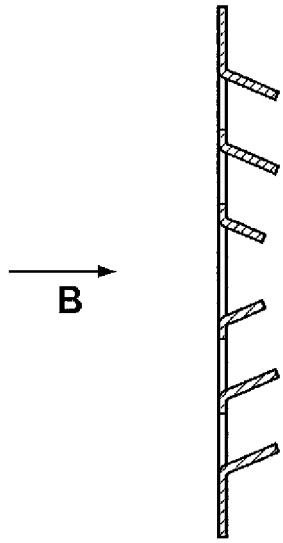
FIG. 11C is a cross sectional view taken along cutting plane A-A of FIG. 11B.

FIGS. 11A and 11B illustrate another alternative embodiment for a flow conditioner formed according to the invention. Plate 111 has through-cuts made to form individual or single tabs 112. Embodiments are also envisioned in which tab pairs are formed in combination with individual tabs. FIG. 11B illustrates the embodiment of FIG. 11A wherein the tabs 112 are bent into position. FIG. 11C is a cross sectional view of FIG. 11B as seen along line A-A. The shape and orientation of tabs 112 can be varied according to differing purposes and user requirements.

In FIG. 11C, arrow B illustrates the flow direction of media to be conditioned. As mentioned above, tabs 112 are single tabs and not tab pairs as shown in previous embodiments. As shown in FIG. 11C, tabs 112 are bent inwardly in the flow direction. Embodiments in which the tabs 112 are bent outwardly into the flow are also envisioned.

Figure 12A:
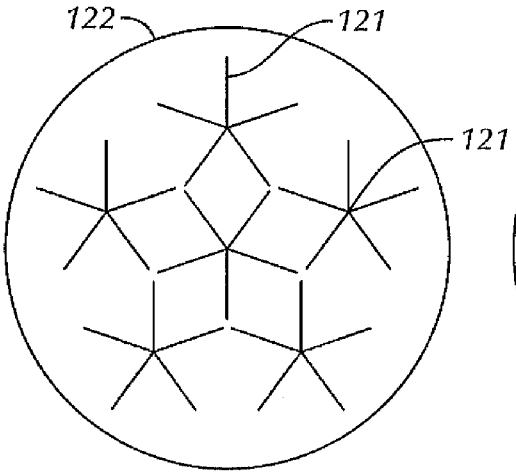
FIG. 12A is a plate with the tabs cut but not bent in an alternative configuration.
Figure 12B:
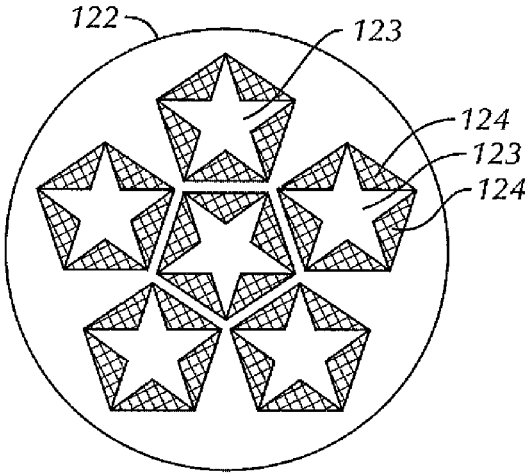
FIG. 12B is the FIG. 12A plate with the tabs bent into position.
Figure 12C:
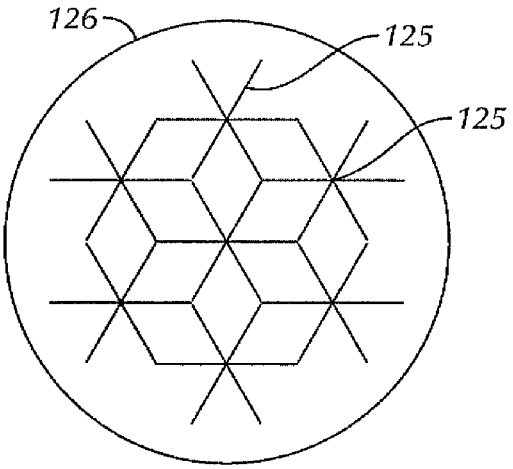
FIG. 12C is an alternative arrangement of the plate, with the tabs cut but not bent.
Figure 12D:
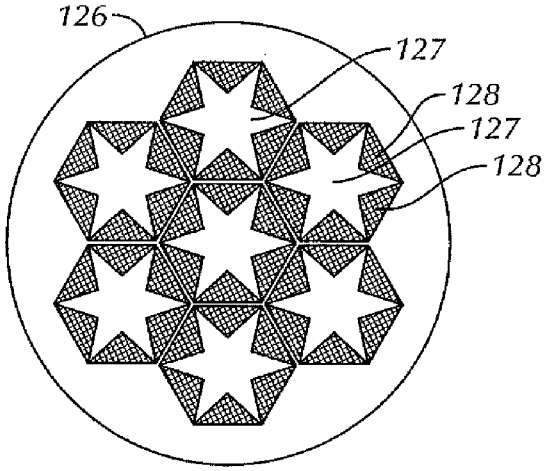
FIG. 12D is the FIG. 12C plate with the tabs bent into position.

FIGS. 12A-12D illustrate alternative embodiments with regard to the number of tabs and the shapes of the orifices (item 79 on FIG. 6G). FIG. 12A shows a cut, pre-bend embodiment of five-star patterns 121 in sheet 122, while FIG. 12B illustrates the five-star pattern opening 123 with tabs 124 bent into position. FIG. 12C shows a pre-bend embodiment of six-star pattern 125 cut onto sheet 126, while FIG. 12D illustrates the six-star pattern of FIG. 12C with the openings 127 and tabs 128 bent into position.

Although five-star and six-star patterns are illustrated, any number of tabs bent from a single orifice can be accommodated. In addition, tabs can be bent into orifices 79 other than pentagonal (FIG. 12B) and hexagonal (FIG. 12D) and can be round, elliptical, trapezoidal, square, rectangular, or any other shape.

Figure 13:
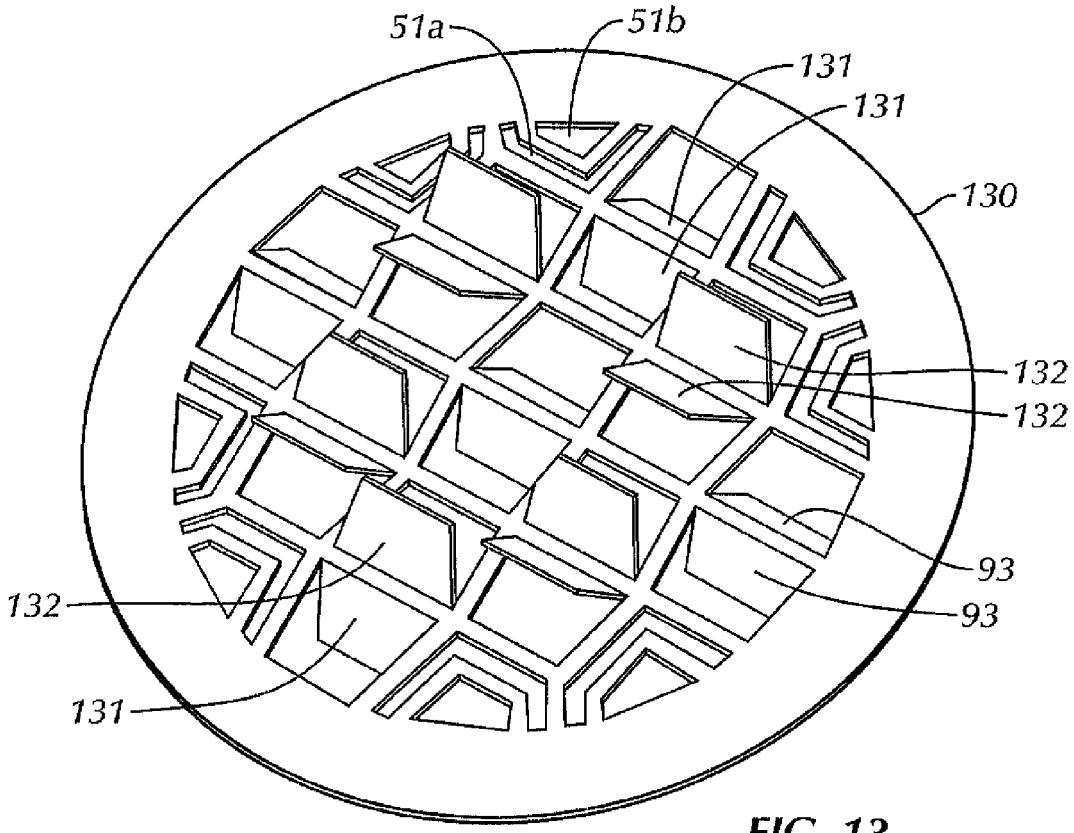
FIG. 13 illustrates an embodiment showing single tabs and sets of tabs angled both upstream and downstream, viewed from the upstream side.

FIG. 13 shows the ability to expose the tabs of plate 130 in all referenced embodiments to both the upstream direction and the downstream direction. This applies to any single set, or any combination of tabs. FIG. 13 shows somewhat of a hybrid embodiment with tabs 131 bent in the downstream direction, tabs 132 bent in the upstream direction from plate 130, and has cutouts (51*a*, 51*b*) of FIG. 5C.

As stated previously, the tabs can be bent in either the upstream or the downstream direction, or may be a mixture, as shown in FIG. 13. The cross hatched tabs of several figures, FIG. 5C being an example, simply show that the tabs have been bent out of the plane of the flow mixer/conditioner plate.

Figure 14:
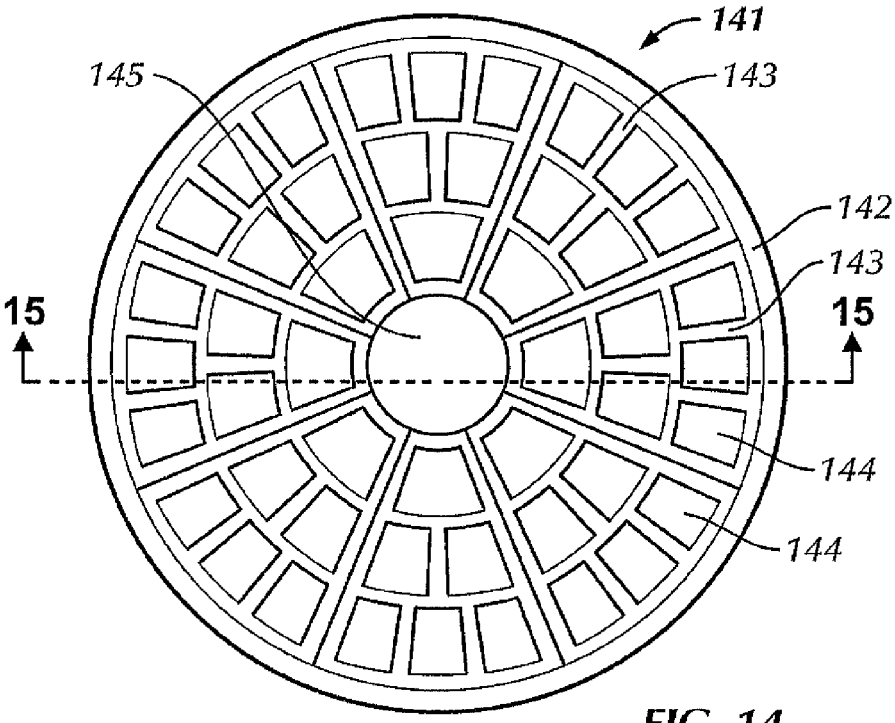
FIG. 14 is a top view of another alternative embodiment having pie-shaped segments with multiple tabs on the segments.
Figure 15:
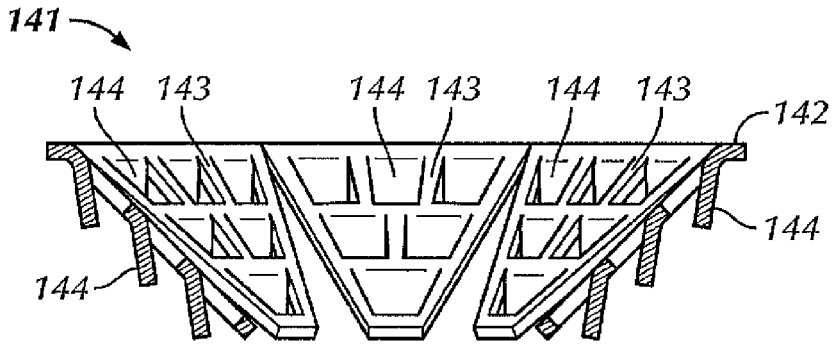
FIG. 15 is a cross sectional view taken along cutting plane 15-15 of FIG. 14, with the segments bent downwardly and tabs in each segment bent downwardly.

With reference to FIGS. 14 and 15, mixer/conditioner body or plate 141 is formed with an annular rim 142 and a plurality of pie-shaped segments 143, each formed with a plurality of tabs 144 bent from annular rib segments that are generally parallel with rim 142. Here, there are eight segments 143 and each segment is formed with six tabs 144. However, there could be more or fewer segments and more or fewer tabs per segment. Some segments may have no tabs formed therein. Plate 141 has a central opening 145 as shown here.

With segments 143 bent in one direction with respect to the surface of rim 142, FIG. 15 shows how the segments and tabs 144 are in the fluid flow path. It should be noted that flow can be in either direction, up or down as viewed in FIG. 15. Those skilled in the art will recognize how this embodiment creates swirl in a consistent manner as fluid flows through plate 141.

Figure 16:
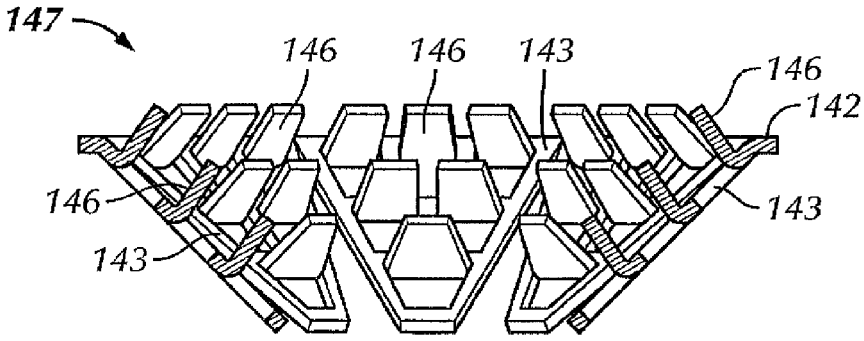
FIG. 16 is a cross section similar to FIG. 15, with the segments bent downwardly and the tabs bent upwardly.

FIG. 16 shows a similar configuration but with tabs 146 bent upwardly from the downwardly bent segments in plate 147. This provides a different swirl pattern to the fluid flowing therethrough.

The FIG. 14-16 embodiment is very versatile in that only some of the segments 143 need to be bent at all from body 141, and some or all of the segments can be bent downwardly or upwardly. In the same manner, only some, or all, of the tabs 144 in any segment can be bent downwardly or upwardly, or not bent at all. The circumstances of the fluid flow in the conduit, and the results desired, will determine which segments or tabs are bent and in what direction, and at what angles.

Figure 17:
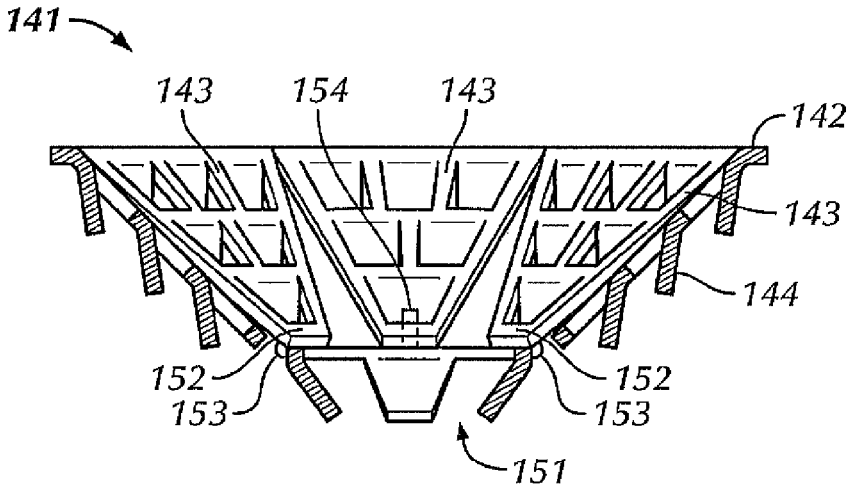
FIG. 17 is similar to the embodiment of FIGS. 14-16 with the addition of a central flow conditioner element.

In FIG. 17 central or core conditioner 151 is attached to the inner ends of bent segments 143 to provide additional conditioning and mixing to that portion of the flowing fluid in the otherwise open center 145 of plate 141. The core conditioner may be attached to the ends 152 of segments 143 by welds 153.

Figure 17A:
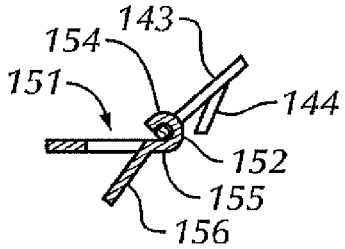
FIG. 17A is an enlarged, fragmentary view of one version of the connection of the central flow conditioner element to one of the bent segments of FIG. 17.

Alternatively, the attachment structure of FIG. 17A may be used. Hook 154 is configured to loop around the end 152 of segment 143. There may be one such hook for each segment, or fewer hooks may be employed. Core conditioner 151 itself may be formed as an annulus 155, from which project tabs 156 at any desired angle.

Core conditioner 151 of FIG. 17 could equally be used with the FIG. 16 configuration, as well as with the FIG. 15 configuration shown.

Figure 18:
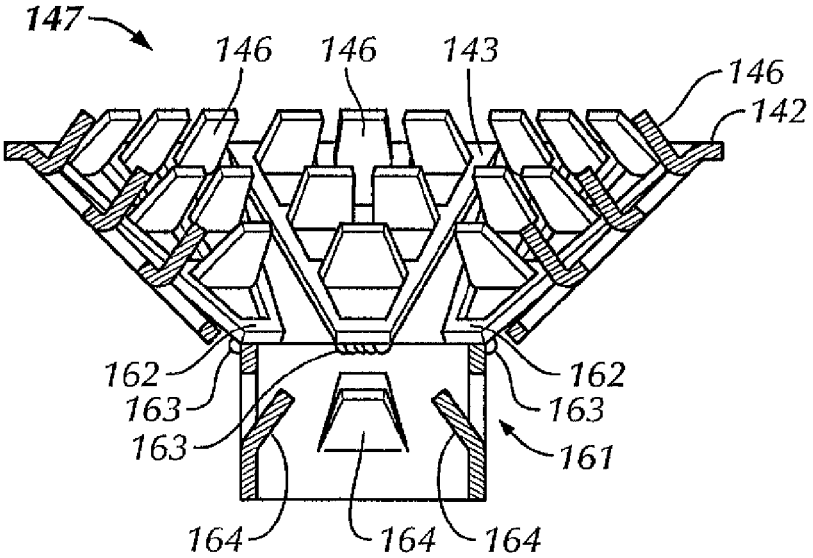
FIG. 18 shows another central flow conditioner element connected to the FIG. 16 configuration.

Core conditioner 161, as shown in FIG. 18, is connected to ends 162 of segments 143 by means of welds 163. Core conditioner 161 is generally cylindrical and has inwardly projecting tabs 164 to condition and mix that portion of the fluid flowing through the center of plate 147.

As with the FIG. 17 embodiment of the core conditioner, core conditioner 161 can be employed with either the FIG. 15 or the FIG. 16 embodiment of plate 141, 146. And equally with FIGS. 14 and 16, flow can be in either direction in the FIGS. 17 and 18 core conditioner embodiments.

While many examples for different embodiments have been shown, they are examples only, to suggest the variety of tab, opening, and grid shapes that are within the scope of this invention and may take the shape and form of any combination of the forms shown that are intended to be exemplary and the tabs can have any conceivable form, shape, angle, or curvature. The body or plate, 30 in FIG. 3 and having different numbers in other figures, is shown generally perpendicular to the direction of media flow, but it can be at a variety of angles. It should be transverse to the flow direction to some degree. The grid members of the segments which remain after the tabs are cut may be reinforced for use as may be necessary or desired, especially in more dense media flows. Accordingly, the invention should be interpreted only with respect to the appended claims and their equivalents.

What is claimed is:

1. A mixing and flow conditioning device configured to be mounted within a conduit having a predetermined cross-sectional topography and size, the conduit being configured to carry media that flows in a predetermined downstream direction, the device comprising:

a unitary flat plate having an annular peripheral flange and a central area within said annular flange, said plate having:

a grid comprised of a plurality of parallel first grid members and a plurality of parallel second grid members, said first and second pluralities of grid members being arranged in a generally right angle intersecting pattern occupying said central area, said grid being co-planar with said annular flange;

tabs extending in pairs, each tab pair being connected and extending non-perpendicularly from opposite sides of each of some of said plurality of first grid members and out of the plane of said flat plate;

said tabs and grid being shaped and configured to provide an ordered downstream flow profile of the flowing media within a length after said flat plate about equal to three cross-sections of the conduit, the resulting flow profile being predictable and having generally parallel flow lines, media swirl being reduced from the amount of swirl at the upstream side of said flat plate.

2. The device according to claim 1, wherein each of said tabs is contiguous with a said first grid member.

3. The device according to claim 1, wherein said flat plate has an opening immediately adjacent each said tab to enable at least a portion of the media to flow through said plate unimpeded.

4. The device according to claim 3, wherein each said opening and each immediately adjacent tab are substantially the same size and shape.

5. The device according to claim 3, wherein said tabs extend at an angle from said first grid members and are shaped and configured to be encountered by a portion of the media flowing through said plate.

6. The device according to claim 1, wherein said tabs are formed out of the material of said plate.

7. The device according to claim 1, wherein some of said tab pairs extend partially downstream in the direction of intended media flow and some of said tab pairs extend partially upstream with respect to the direction of intended media flow.

8. A mixing and flow conditioning apparatus configured to be mounted within a conduit having a predetermined cross-sectional topography and size, the conduit being configured to carry media that flows in a predetermined downstream direction, the apparatus comprising:

a unitary flat plate comprising a plane of predetermined thickness, said plate being 6 configured to fit within the conduit in a generally perpendicular orientation to the flow direction of the media, said plate being formed with a central grid of a plurality of first grid members and a plurality of second grid members, said first and second grid members being generally mutually perpendicular in the plane of said flat plate and forming openings therethrough to permit media to flow through said plate, said grid being surrounded with an annular peripheral flange in the plane of said plate; and a plurality of tabs, each extending at a non-perpendicular angle from said plate and being contiguous with some of said first grid members, each said tab of said plurality of tabs extending in a predetermined direction out of the plane of said plate.

9. The apparatus according to claim 8, wherein said plurality of tabs comprise at least one said pair of tabs configured to diverge in the flow direction from a common first grid member from the plane of said plate.

10. The apparatus according to claim 8, wherein some tabs of said plurality of tabs extend partially downstream in the direction of intended media flow and some tabs of said plurality of tabs extend partially upstream with respect to the direction of intended media flow.

11. The apparatus according to claim 8, wherein some tabs of said plurality of tabs are arranged in pairs, each tab of each said pair being bent at the same angle as the other tab of each said pair from a said first grid member.

12. A mixing and flow conditioning apparatus configured to be mounted within a conduit having a predetermined cross-sectional topography and size, the conduit being configured to carry media that flows in a predetermined downstream direction, the apparatus comprising:

a unitary flat plate configured to reside generally transversely within the conduit and to be oriented substantially perpendicular to the media flow direction;

a plurality of tabs, each tab of said plurality of tabs having a predetermined shape and being configured to extend at a non-perpendicular angle from said plate into the media flow; and a central grid defined by a plurality of parallel first grid members and a plurality of parallel second grid members arranged at right angles to said first grid members, said central grid being configured to define a plurality of openings through said plate through which the media is permitted to flow, said tabs being contiguous with said grid, said grid being contiguous and planar with said plate.

13. The apparatus according to claim 12, wherein at least some of said tabs of said plurality of tabs extend in the downstream direction from said plate.

14. The apparatus according to claim 12, wherein at least some of said tabs of said plurality of tabs extend in the upstream direction from said plate.

15. A mixing and flow conditioning device for use within a conduit having a predetermined cross-sectional topography and size, the conduit being configured to carry media that flows in a predetermined downstream direction within the conduit, the device comprising:

a unitary flat plate having a center axis, said plate being configured to be mounted in the conduit in a manner to generally accommodate the cross-sectional topography of the conduit;

a plurality of tabs cut out of and bent from said plate, each said tab extending at a predetermined non-perpendicular angle out of the plane of said plate; and a unitary flat framework of a plurality of first grid members and a plurality of second grid members arranged in a mutually perpendicular grid remaining in a center portion of said flat plate and in the plane of said flat plate from which said tabs are integral and bent, said plate and said framework of grid members being generally planar, said framework of grid members being surrounded by an annular flange or flange portion of said plate, each tab of said plurality of tabs being bent from some of said first grid members, said framework of grid members defining a plurality of openings through said plate through which openings the media is permitted to flow, only a portion of the media flowing through the openings impinging upon a tab;

said tabs and framework being shaped and configured to provide an ordered downstream flow profile of the flowing media within a length after said flat plate about equal to three cross-sections of the conduit, the resulting flow profile being predictable and having generally parallel flow lines, media swirl being reduced from the amount of swirl at the upstream side of said flat plate.

* * * * *